US009922605B2

(12) United States Patent
Jang

(10) Patent No.: US 9,922,605 B2
(45) Date of Patent: Mar. 20, 2018

(54) DISPLAY DEVICE AND DRIVING METHOD THEREOF

(71) Applicant: SAMSUNG DISPLAY CO., LTD., Yongin, Gyeonggi-Do (KR)

(72) Inventor: Dae-Gwang Jang, Cheonan-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 394 days.

(21) Appl. No.: 14/479,730

(22) Filed: Sep. 8, 2014

(65) Prior Publication Data

US 2015/0187291 A1 Jul. 2, 2015

(30) Foreign Application Priority Data

Dec. 31, 2013 (KR) ..... 10-2013-0169355

(51) Int. Cl.
*G09G 5/02* (2006.01)
*G09G 5/00* (2006.01)
*G09G 3/36* (2006.01)

(52) U.S. Cl.
CPC ..... *G09G 3/3611* (2013.01); *G09G 3/3655* (2013.01); *G09G 3/3696* (2013.01); *G09G 2320/0204* (2013.01); *G09G 2320/0285* (2013.01); *G09G 2320/0626* (2013.01); *G09G 2320/0693* (2013.01)

(58) Field of Classification Search
None
See application file for complete search history.

(56) References Cited

U.S. PATENT DOCUMENTS

2002/0089477 A1* 7/2002 Kanbe ..... G09G 3/3648 345/87
2005/0259092 A1* 11/2005 Aoki ..... G09G 3/3648 345/204
2006/0050042 A1* 3/2006 Yi ..... G09G 3/3696 345/98
2006/0145995 A1* 7/2006 Kim ..... G09G 3/3655 345/98
2007/0001963 A1 1/2007 Koma
2007/0164947 A1* 7/2007 Lin ..... G09G 3/3648 345/87

(Continued)

FOREIGN PATENT DOCUMENTS

JP 11-024634 A 1/1999
KR 10-2009-0005424 A 1/2009

(Continued)

*Primary Examiner* — Christopher R Lamb
(74) *Attorney, Agent, or Firm* — Lee & Morse, P.C.

(57) ABSTRACT

A display device includes a display unit, a common voltage measuring unit, and a signal controller. The display unit include a plurality of pixels, each including a liquid crystal capacitor including a terminal coupled to a common electrode to receive a common voltage and a pixel electrode to receive a gray scale voltage. The common voltage measuring unit measures a change in the common voltage resulting from a coupling between the common electrode and the pixel electrode when a test image including a specific pattern is output to the display unit. The signal controller detects a level of a residual DC voltage of a liquid crystal layer between the common electrode and pixel electrode based on a measured value of the common voltage.

16 Claims, 21 Drawing Sheets

(56) References Cited

U.S. PATENT DOCUMENTS

| | | | | |
|---|---|---|---|---|
| 2008/0129902 | A1* | 6/2008 | Qi | G02F 1/133345 349/33 |
| 2009/0179882 | A1* | 7/2009 | Uchiyama | G09G 3/3655 345/207 |
| 2010/0073341 | A1* | 3/2010 | Toyooka | G09G 3/3614 345/208 |
| 2012/0162182 | A1* | 6/2012 | Lin | G09G 3/006 345/212 |
| 2014/0062990 | A1* | 3/2014 | Zhang | G09G 3/3696 345/212 |

FOREIGN PATENT DOCUMENTS

| | | | |
|---|---|---|---|
| KR | 10-2009-0063689 | A | 6/2009 |
| KR | 10-2010-0019246 | A | 2/2010 |

* cited by examiner

DISPLAY DEVICE AND DRIVING METHOD THEREOF

CROSS-REFERENCE TO RELATED APPLICATION

Korean Patent Application No. 10-2013-0169355, filed on Dec. 31, 2013, and entitled, "Display Device and Driving Method Thereof," is incorporated by reference herein in its entirety.

BACKGROUND

1. Field

One or more embodiments described herein relate to a display device and driving method thereof.

2. Description of the Related Art

A liquid crystal display includes has a plurality of pixels, each including a liquid crystal layer between a pixel electrode and a common electrode. The pixel electrodes are arranged in a matrix form and are connected to switching elements, such as a thin film transistor (TFT). The common electrode is formed over the entire surface of a display panel and is applied with a common voltage. In one circuit configuration, the pixel electrode, common electrode, and liquid crystal layer form a liquid crystal capacitor.

In such a display, a DC voltage is applied to the pixel and common electrodes to generate an electric field in the liquid crystal layer. Light of a certain amount is transmitted through the liquid crystal layer by controlling intensity of the electric field to obtain a desired image.

When the liquid crystal display is driven for a long period of time, or an electric field in one direction is applied to the liquid crystal layer for a long period of time, the electric field is biased to a higher side or lower side based on the common voltage and ions are stuck on an alignment layer of the pixel electrode. As a result, a kind of residual DC voltage exists between the pixel electrode and alignment layer.

When a voltage having polarity opposite to the common voltage is applied, the residual DC voltage weakens the electric field in the liquid crystal. When a voltage having the same polarity as the common voltage is applied, the residual DC voltage strengthens the electric field in the liquid crystal. Therefore, a gray imbalance of the liquid crystal display occurs, which is displayed as an afterimage.

SUMMARY

In accordance with one embodiment, a display device includes a display unit including a plurality of pixels, each of the pixels including a liquid crystal capacitor including a terminal coupled to a common electrode to receive a common voltage and a pixel electrode to receive a gray scale voltage; a common voltage measuring unit to measure a change in the common voltage resulting from a coupling between the common electrode and the pixel electrode when a test image including a specific pattern is output to the display unit; and a signal controller to detect a level of a residual DC voltage of a liquid crystal layer between the common electrode and pixel electrode based on a measured value of the common voltage.

The common voltage measuring unit may include a differential amplifier to amplify the common voltage based on a reference value; and an analog-to-digital converter (ADC) to generate a measurement signal corresponding to a level of the amplified common voltage, and to transfer the generated measurement signal to the signal controller.

The test image may include a plurality of lines having a white gray scale value and a remaining region having a black gray scale value. The test image may include a plurality of lines having a low or intermediate gray scale value and a remaining region having a black gray scale value.

The signal controller may normalize a measured result of the common voltage at an initial driving time and may store the normalized measured result as an initial measurement value. The signal controller may detect the level of the residual DC voltage based on a difference between the initial measurement value and a measured result of a subsequently measured common voltage.

The display device may include a data driver to apply gray scale voltages to the pixels; and a gray voltage generator to apply a reference gray voltage for generating the gray voltages to the data driver, wherein the signal controller transfers a gray voltage control signal to the data driver, the gray scale voltage control single to change the reference gray voltages based on the level of the residual DC voltage.

The signal controller may compensate for an image data signal transferred to the data driver depending on the level of the residual DC voltage.

The display device may include a data driver to apply the gray scale voltages to the pixels, wherein the signal controller transfers a gray voltage control signal to the data driver, the gray scale voltage control signal to change a reference gray scale voltage for generating the gray scale voltages depending on the level of the residual DC voltage. The signal controller may compensate for an image data signal transferred to the data driver depending on the level of the residual DC voltage.

The display device may include a data driver to apply gray scale voltages to the pixels, wherein the signal controller compensates for an image data signal transferred to the data driver depending on the level of the residual DC voltage.

In accordance with another embodiment, a method for driving a display device includes outputting a test image to a display unit; measuring a common voltage which has changed due to coupling between a common electrode and a pixel electrode of a pixel in the display unit; and detecting a level of a residual DC voltage of a liquid crystal layer between the common electrode and pixel electrode based on a measured value of the common voltage.

Measuring of the common voltage may include amplifying the common voltage based on a reference value; and generating a measurement signal corresponding to a level of the amplified common voltage.

Outputting of the test image to a display unit may include displaying a plurality of lines on the display unit having a white gray scale value and displaying a remaining region having a black gray scale value.

Outputting of the test image to a display unit may include displaying a plurality of lines on the display unit having a low or intermediate gray scale value and displaying a remaining region thereon having a black gray scale value.

The method may include determining whether an initial measurement value is stored when a power supply is turned on. The method may include outputting a test image in the display unit when the initial measurement value is not stored, measuring the common voltage which has changed due to the coupling between the common electrode and pixel electrode when the test image is output, normalizing a measured result of the common voltage, and storing the normalized measured result as an initial measurement value.

The method may include changing a reference gray scale voltage for generating a gray scale voltage to be applied to the pixel electrode depending on the level of the residual DC voltage. The method may include compensating for an image data signal transferred to a data driver by applying a gray voltage to the pixel depending on the level of the residual DC voltage.

The method may include changing a reference gray scale voltage for generating a gray voltage applied to the pixel electrode depending on the level of the residual DC voltage; and compensating for an image data signal transferred to a data driver applying a gray scale voltage to the pixel depending on the level of the residual DC voltage.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Figure 1:
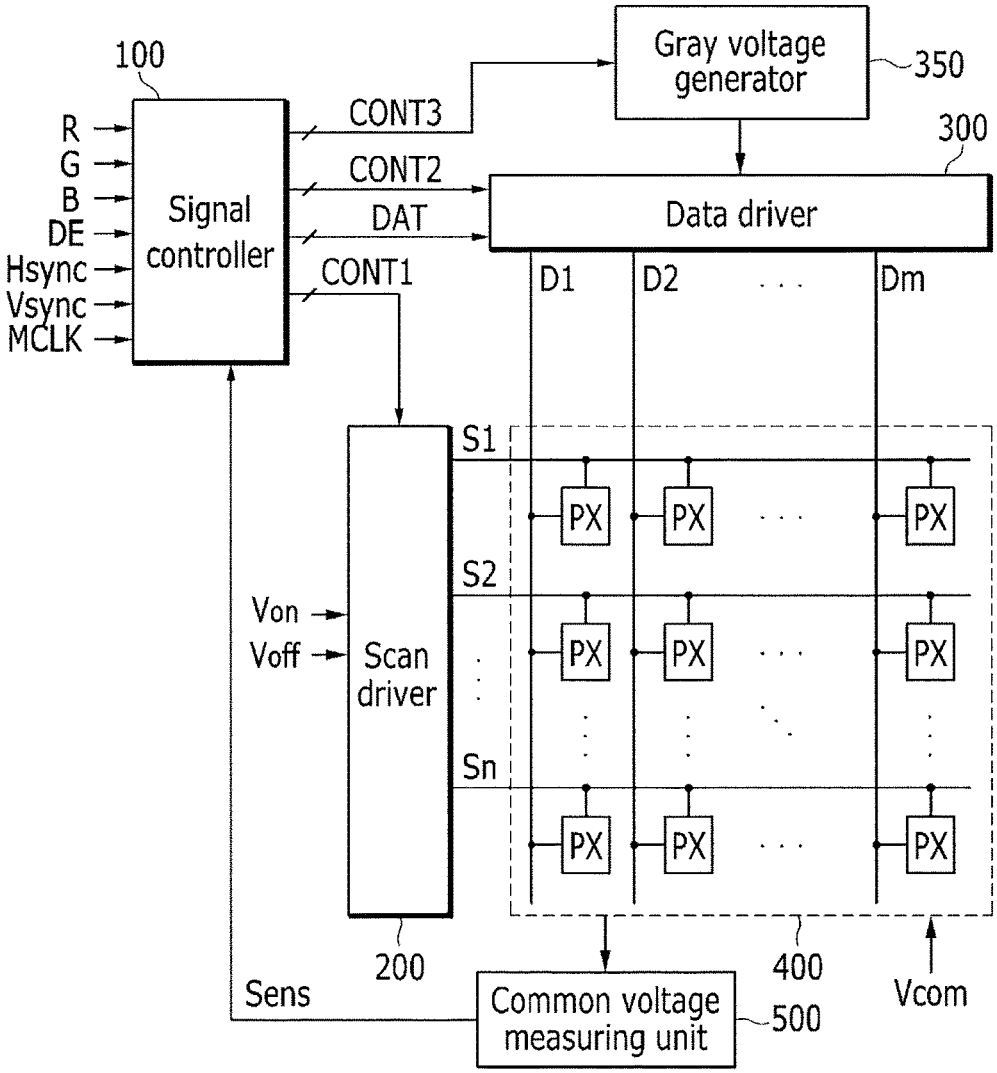
FIG. 1 illustrates an embodiment of a display device.

FIG. 1 illustrates an embodiment of a display device which includes a signal controller 100, a scan driver 200, a data driver 300, a gray voltage generator 350, a display unit 400, and a common voltage measuring unit 500.

The display unit 400 includes a plurality of scanning lines S1 to Sn, a plurality of data lines D1 to Dm, and a plurality of pixels PXs. The pixels PXs are connected to scanning lines S1 to Sn and data lines D1 to Dm, and are arranged in approximately a matrix form. The scanning lines S1 to Sn extend in approximately a row direction and are substantially parallel with each other. The data lines D1 to Dm extend in approximately a column direction and are substantially parallel with each other.

The display unit 400 may be a liquid crystal panel assembly, which includes a thin film transistor array panel (see 10 of FIG. 2), a common electrode array panel (see 20 of FIG. 2) opposite thereto, and a liquid crystal layer (see 15 of FIG. 2) between the two array panels 10 and 20. An outer surface of the display unit 400 may be attached with at least one polarizer which polarizes light.

The signal controller 100 receives image signals R, G, and B and an input control signal which controls display of image signals. The input control signal includes a data enable signal DE, a horizontal synchronization signal Hsync, a vertical synchronization signal Vsync, and/or a main clock signal MCLK.

The signal controller 100 transfers an image data signal DAT and a data control signal CONT2 to the data driver 300. The data control signal CONT2 controls operation of data driver 300 and includes a horizontal synchronization start signal STH (indicative of a transmission start of the image data signal DAT), a load signal LOAD (indicative of output of a gray voltage to data lines D1 to Dm), and a data clock signal HCLK. The data control signal CONT2 may include an inversion signal RVS that inverts a voltage polarity of the image data signal DAT for a common voltage Vcom.

The signal controller 100 transfers a scanning control signal CONT1 to the scan driver 200. The scanning control signal CONT1 includes a scanning start signal STV from scan driver 200 and at least one clock signal which controls output of a gate-on voltage Von. The scanning control signal CONT1 may further include an output enable signal OE which limits the duration of the gate-on voltage Von.

The signal controller 100 transfers a gray voltage control signal CONT3 to a gray voltage generator 350. The gray voltage control signal CONT3 sets a voltage value of a reference gray voltage Vref, provided from the gray voltage generator 350, to the data driver 300.

The data driver 300 is connected to the data lines D1 to Dm of the display unit 400 and selects a gray voltage corresponding to the image data signal DAT from the gray voltage generator 350. The data driver 300 applies the selected gray voltage to the data lines D1 to Dm.

The gray voltage generator 350 may provide only a predetermined number of reference gray voltage Vref to the data driver 300 without providing all the gray voltages. In this case, data driver 300 may divide the reference gray voltage Vref to generate the gray voltages for all grays and select a gray voltage corresponding to the image data signal DAT among the gray voltages.

The present embodiment illustrates that the gray voltage generator 350 is provided separately from the data driver 300, but the gray voltage generator 350 may be included in the data driver 300 in other embodiments.

The scan driver 200 is connected to and applies a scanning signal to scanning lines S1 to Sn of the display unit 400. The scanning signal may be a gate-on voltage Von (which turns on switching element, e.g., Q of FIG. 2) or a gate-off voltage Voff for turning off the switching element.

The common voltage measuring unit 500 measures common voltage Vcom and transfers a measurement signal Sens to signal controller 100. In one embodiment, when a test image including a specific pattern is output to display unit 400, common voltage measuring unit 500 measures a common voltage Vcom, which is changed due to coupling between a common electrode (see CE of FIG. 2) and a pixel electrode (see PE of FIG. 2). The common voltage measuring unit 500 may amplify the common voltage Vcom to generate measurement signal Sens and then transfers measurement signal Sens to signal controller 100.

The signal controller 100 detects a level of a residual DC voltage of the liquid crystal layer (see 15 of FIG. 2) based on the measurement signal Sens and compensates for the residual DC voltage.

The signal controller 100, the scan driver 200, the data driver 300, and the gray voltage generator 350 may be directly mounted on the display unit 400 in one or more IC chips or may be mounted on a flexible printed circuit film (FPC) attached to the display unit 400, for example, in a tape carrier package (TCP). Alternatively, the signal controller 100, the scan driver 200, the data driver 300, and the gray voltage generator 350 may be mounted on a separate printed circuit board (PCB). Alternately, the signal controller 100, the scan driver 200, the data driver 300, and the gray voltage generator 350 may be integrated in the display unit 400, along with the scanning lines S1 to Sn and the data lines D1 to Dm.

Figure 2:
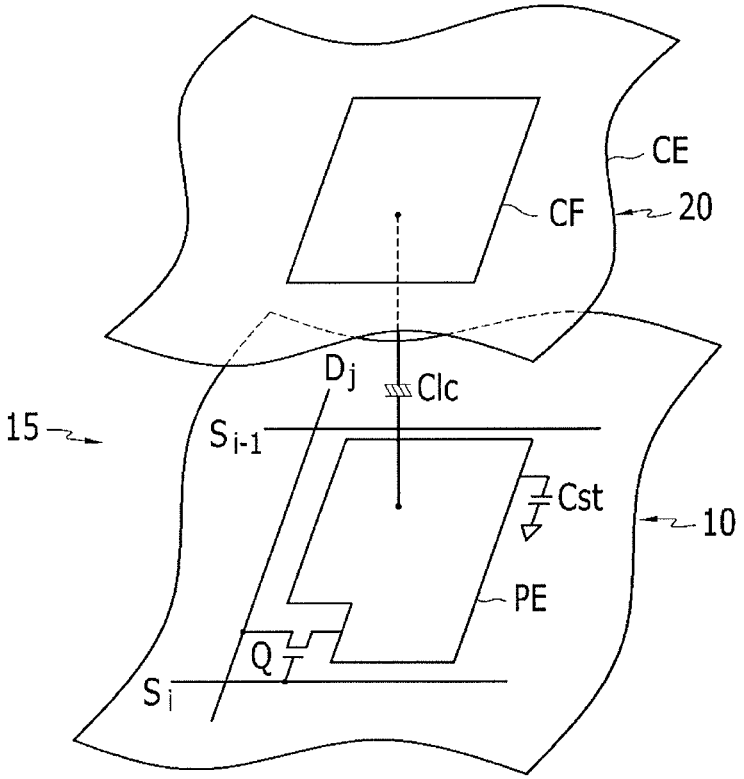
FIG. 2 illustrates an embodiment of a pixel.

FIG. 2 illustrates an embodiment of a pixel PX, which, for example, may be included in the display unit 400 of FIG. 1. The pixel PX in FIG. 2 is connected to an i-th (I=1 to n) scanning line Si and a j-th (j=1 to m) data line Dj. The pixel PX includes a switching element Q and a liquid crystal capacitor Clc and a sustain capacitor Cst connected to the switching element Q.

The switching element Q is a three-terminal element such as a thin film transistor included in thin film transistor array panel 10. The switching element Q includes a gate terminal connected to scanning lines S1 to Sn, an input terminal connected to the data lines D1 to Dm, and an output terminal connected to the liquid crystal capacitor Clc and the sustain capacitor Cst. The thin film transistor includes amorphous silicon or polysilicon.

The thin film transistor may be an oxide thin film transistor (oxide TFT) in which a semiconductor layer is made of oxide semiconductor. The oxide semiconductor may include an oxide based on one of titanium (Ti), hafnium (Hf), zirconium (Zr), aluminum (Al), tantalum (Ta), germanium (Ge), zinc (Zn), gallium (Ga), tin (Sn), or indium (In), and any one of zinc oxide (ZnO), indium-gallium-zinc oxide (InGaZnO4), indium-zinc oxide (Zn—In—O), zinc-tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), or hafnium-indium-zinc oxide (Hf—In—Zn—O), all of which are composite oxides.

The semiconductor layer includes a channel region which is not doped with impurities and a source region and a drain region formed by doping respective sides of the channel region with impurities. The impurity varies depending on a kind of the thin film transistor and may be an N-type impurity or a P-type impurity.

When the semiconductor layer is made of the oxide semiconductor, a separate protective layer may be added to protect the oxide semiconductor which is vulnerable to external environments such as exposure to high temperatures.

The liquid crystal capacitor Clc uses the pixel electrode (PE) of the thin film transistor array panel 10 and the common electrode (CE) of the common electrode panel 20 as two terminals. The liquid crystal layer 15 may serve as a dielectric material between the pixel electrode (PE) and the common electrode (CE). The liquid crystal layer 15 may have dielectric anisotropy.

The pixel electrode (PE) is connected to the switching element Q and common electrode (CE) is formed over the entire surface of the common electrode panel 20 and is applied with common voltage Vcom. In another embodiment, common electrode (CE) may be provided on thin film transistor array panel 10. In this case, at least one of the two electrodes PE and CE may be made in a line shape or a bar shape.

The sustain capacitor Cst assists in the functioning of the liquid crystal capacitor Clc, and may be formed by superimposing separate signal lines and the pixel electrode (PE) provided on thin film transistor array panel 10. An insulator may be disposed between them, and the separate signal lines may be applied with a predetermined voltage such as the common voltage Vcom.

A region of the common electrode (CE) of the common electrode panel 20 may be provided with a color filter (CF). Each pixel PX may emit a desired color based on a spatial sum of primary colors. Each pixel PX may alternately display the primary colors over time and may emit the desired color based on a temporal sum of the primary colors. An example of the primary colors includes three primary colors such as red, green, and blue.

FIG. 2 illustrates that each pixel PX includes a color filter (CF) representing one of the primary colors in a region of common electrode panel 20 corresponding to the pixel electrode (PE) as one example of spatial division. In another embodiment, the color filter (CF) may be formed above or under the pixel electrode (PE) of the thin film transistor array panel 10.

Figure 3:
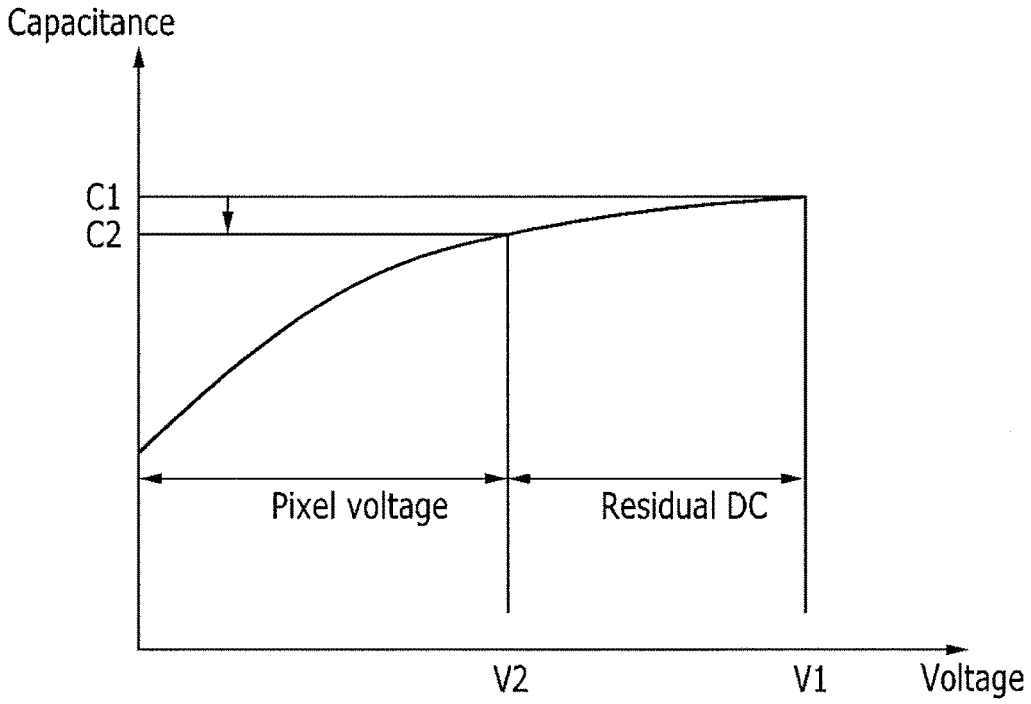
FIG. 3 illustrates an example of a relationship between a pixel voltage and a capacitance of a liquid crystal capacitor.

FIG. 3 is a graph illustrating an example of a relationship between pixel voltage and capacitance of a liquid crystal capacitor. Referring to FIG. 3, the liquid crystal capacitor Clc is a dynamic capacitor. Thus, the capacitance of the liquid crystal capacitor Clc varies depending on a voltage difference between the pixel electrode (PE) and the common electrode (CE), e.g., a pixel voltage. For example, liquid crystal layer 15 has dielectric anisotropy. Therefore, a dielectric constant changes within the electric field between the pixel electrode (PE) and the common electrode (CE) depending on the orientation of liquid crystal. The change in the dielectric constant produces a change in the capacitance of the liquid crystal capacitor Clc. The orientation of the liquid crystal changes depending on the pixel voltage.

As illustrated in FIG. 3, a predetermined voltage is applied to the pixel electrode (PE) and the common electrode (CE) before a residual DC voltage is generated. When a pixel voltage V1 is generated, the capacitance of the liquid crystal capacitor Clc becomes C1. When the residual DC voltage is generated, even though the same voltage as the voltage generating the pixel voltage V1 is applied to the pixel electrode PE and common electrode CE, the pixel voltage changes from V1 to V2 by the residual DC voltage. As a result, the capacitance of the liquid crystal capacitor Clc changes from C1 to C2.

When a predetermined gray scale voltage is applied to the pixel electrode (PE), the common voltage Vcom instantly changes due to coupling between the pixel electrode (PE) and common electrode (CE). When the capacitance of the liquid crystal capacitor Clc changes by the residual DC voltage, a changed amount of the common voltage Vcom (due to coupling between the pixel electrode (PE) and the common electrode (CE)) is changed.

According to the proposed display device, the level of the residual DC voltage of the liquid crystal layer 15 is measured by measuring the changed amount of common voltage Vcom (due to coupling between the pixel electrode (PE) and the common electrode (CE)) when the predetermined gray scale voltage is applied to the pixel electrode (PE) and the residual DC voltage is compensated. As a result, an imbalance in gray scale values of the display device may be reduced or prevented.

Figure 4:
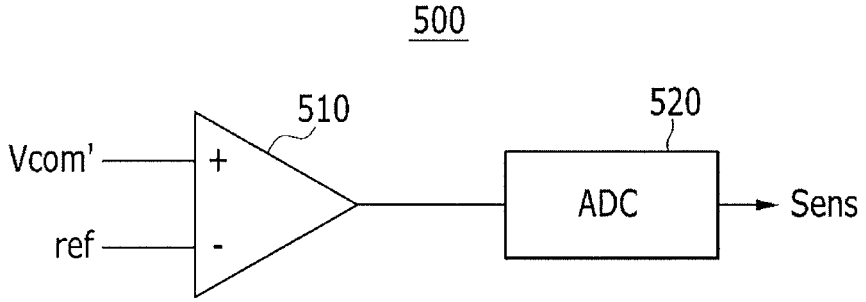
FIG. 4 illustrates an embodiment of a common voltage measuring unit.

FIG. 4 illustrates an embodiment of a common voltage measuring unit 500 which includes a differential amplifier 510 and an analog-to-digital converter (ADC) 520. A first input terminal (+) of differential amplifier 510 is connected to common electrode (CE) and receives a common voltage Vcom' measured by the common electrode (CE). A second input terminal (−) of differential amplifier 510 receives a reference value Ref. The differential amplifier 510 amplifies common voltage Vcom' based on the reference value Ref and outputs the amplified common voltage Vcom'.

The ADC 520 receives the amplified common voltage Vcom' and generates measurement signal Sens based on the level of the common voltage Vcom'. The measurement signal is a digital signal corresponding to the level of the common voltage Vcom'. The measuring signal Sens is transferred to the signal controller 100.

Hereinafter, in the display device, a method for measuring the level of the residual DC voltage of the liquid crystal layer 15 by measuring the changed amount of the common voltage Vcom due to the coupling between the pixel electrode (PE) and the common electrode (CE) when the predetermined gray voltage is applied to the pixel electrode (PE) and compensating for the residual DC voltage will be described.

Figure 5:
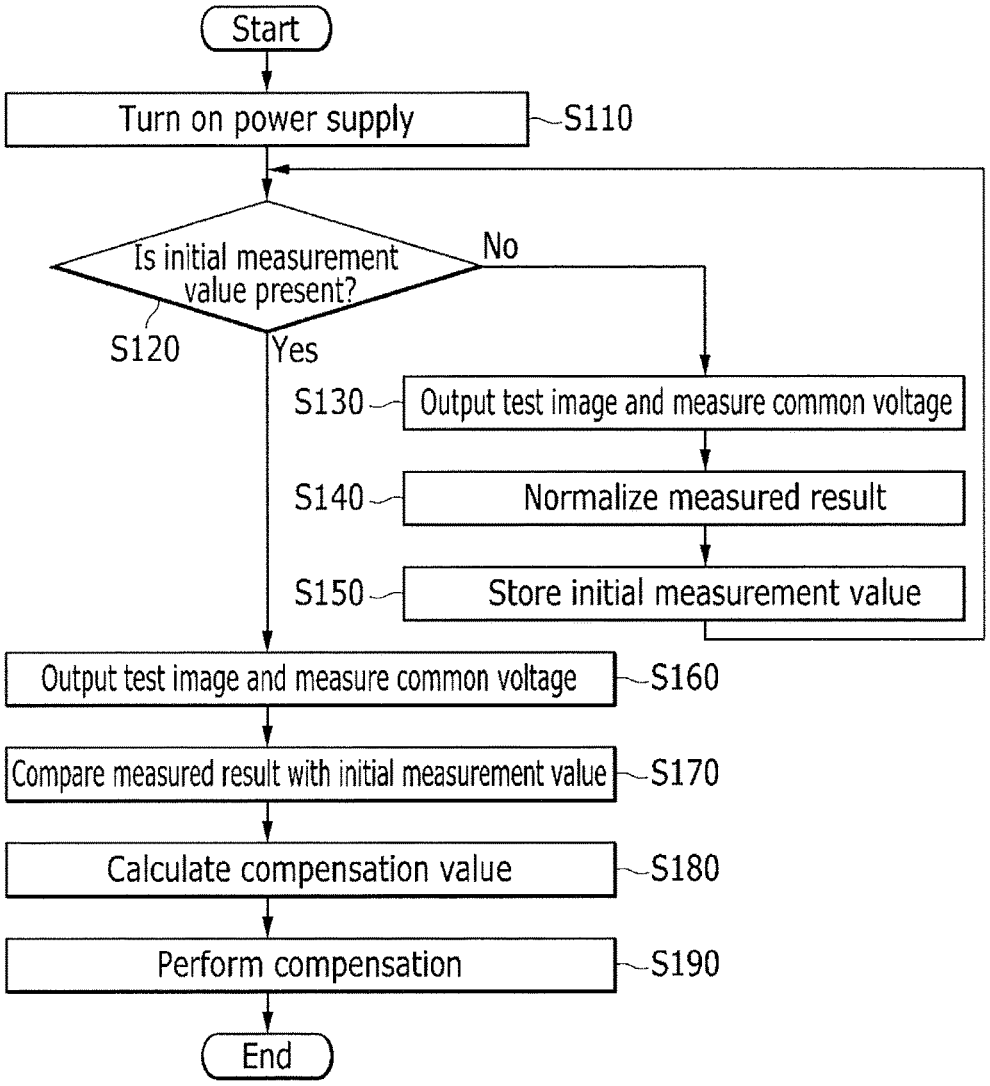
FIG. 5 illustrates an embodiment of method for driving a display device.

FIG. 5 illustrates an embodiment of a method for driving a display device. Referring to FIG. 5, a power supply for the display device is turned on (S110). When the power supply for the display device is turned on, an image is not directly displayed because a predetermined ready time is required. The following process of measuring the level of the residual DC voltage may be performed during this ready time. The present embodiment illustrates that when the power supply for the display device is turned on, the process of measuring the level of the DC voltage is performed. When the display device is driven for a long period of time, the process of measuring the level of the DC voltage may also be performed in a specific time.

According to this process, signal controller 100 determines whether an initial measurement value Vcom'_init is present (S120). The initial measurement value Vcom'_init may be a normalized value of the measurement common voltage Vcom' measured at the time when the display device is first or initially driven.

When no initial measurement value is present, signal controller 100 performs the process of outputting a test image and measuring common voltage Vcom (S130). The common voltage Vcom is measured by common voltage measuring unit 500. The test image includes a predetermined common specific pattern.

Figure 6:
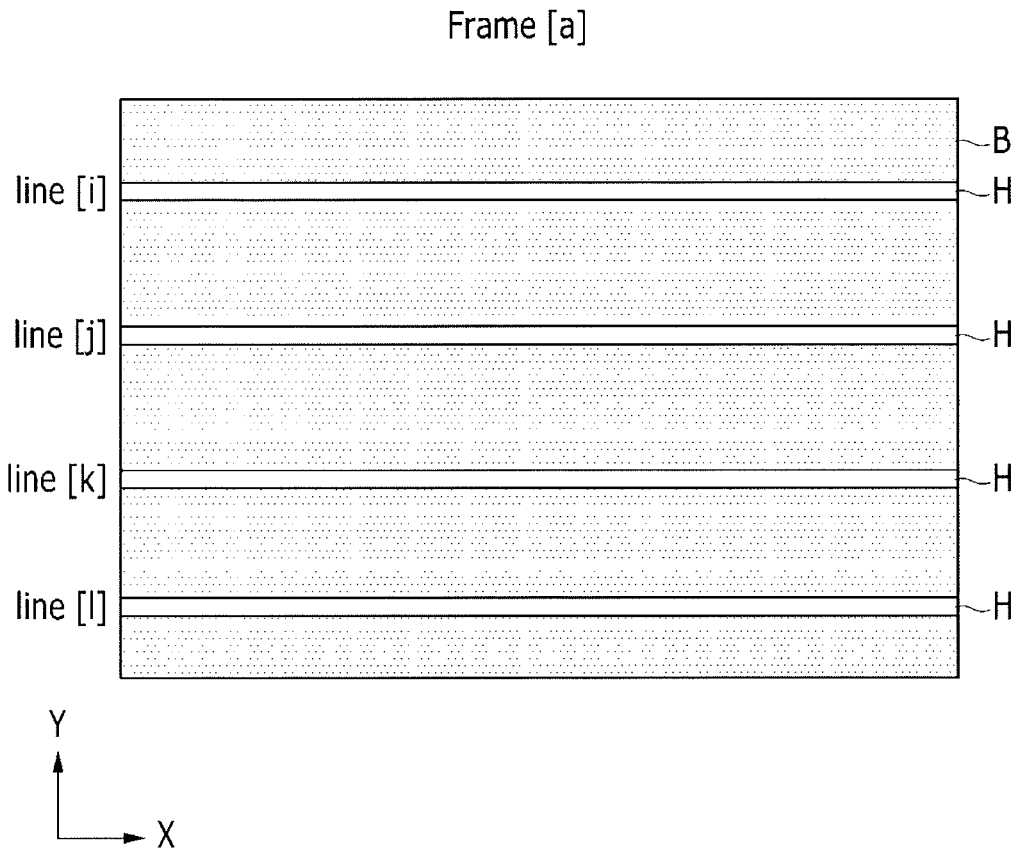
FIGS. 6 and 7 illustrate a test image for measuring a common voltage.
Figure 7:
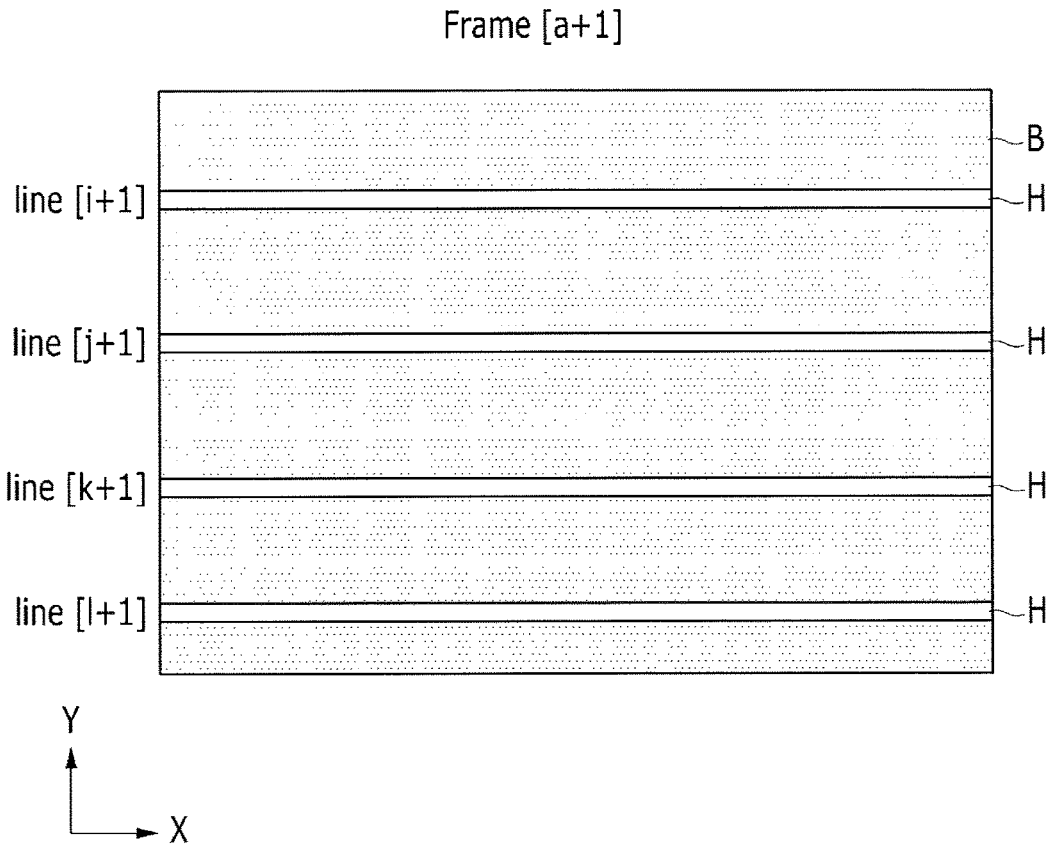

FIGS. 6 and 7 illustrate an example of a test image for measuring a common voltage. As illustrated in FIGS. 6 and 7, the test image may be an image which displays a plurality of lines line [i], line [j], line [k], and line [l] extending in an X direction on a screen by a high (lighter) gray scale value H and displays the remaining region by a low gray (e.g., black) scale value. For example, pixels corresponding to line [i], line [j], line [k], and line [l] may receive a maximum gray scale voltage. In this case, pixels PXs corresponding to line [i], line [j], line [k], and line [l] may receive only a positive gray scale voltage. Alternatively, pixels PXs corresponding to line [i], line [j], line [k], and line [l] may receive only a negative gray voltage.

The pixels PXs corresponding to line [i], line [j], line [k], and line [l] receive one of the positive or negative gray voltages as the maximum gray voltage. As a result, the common voltage Vcom is changed by a relatively large amount due to the coupling. The changed common voltage Vcom is measured.

Line [i], line [j], line [k], and line [l] are displayed by a lighter (e.g., white) gray scale value H in one frame Frame [a]. Then, the lines displayed by the white gray H in the next frame Frame [a+1] move in a Y direction line by line. As a result, line [i+1], line [j+1], line [k+1], and line [l+1] are displayed by the white gray H. By this method, when the common voltage Vcom is measured during a time when the line displayed by the white gray H is scrolled in the Y direction, the common voltage Vcom for each X-direction line in all the pixels PXs may be measured.

According to this method, the common voltage Vcom may be measured by applying only the positive gray scale voltage to pixel PX. Then, common voltage Vcom may be measured by applying only the negative gray voltage to the pixel PX.

Figure 8:
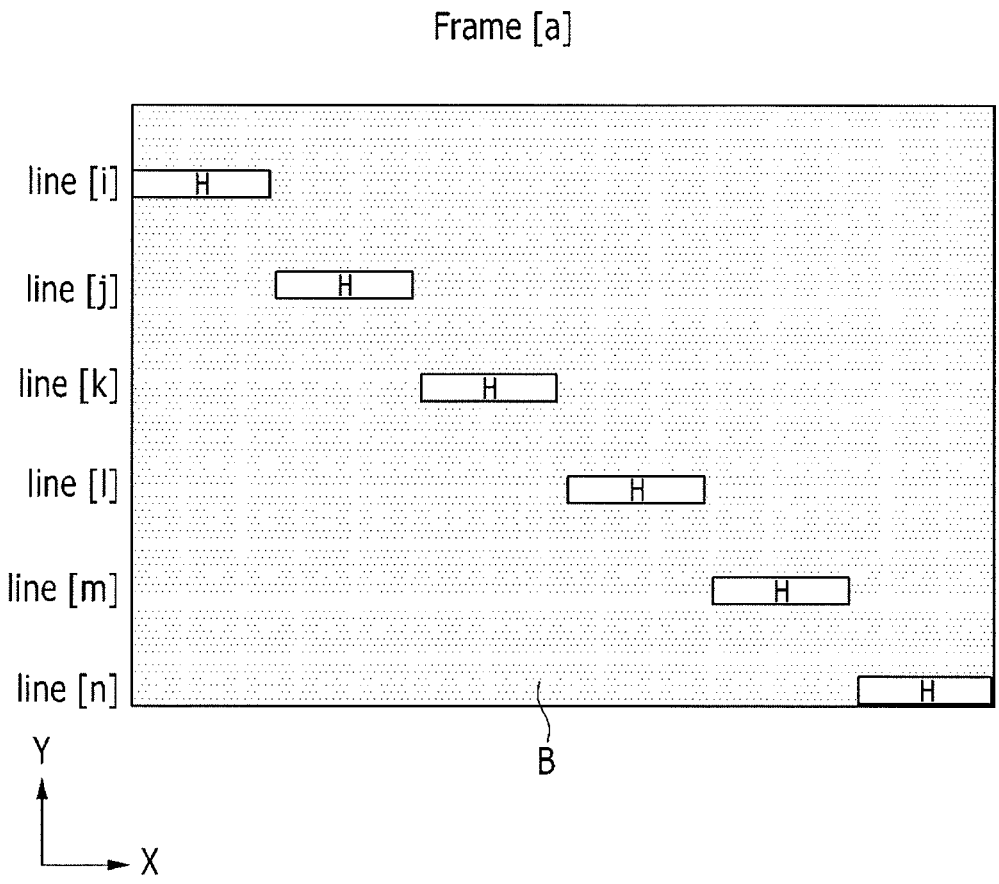
FIGS. 8 and 9 illustrate another example of a test image for measuring a common voltage.
Figure 9:
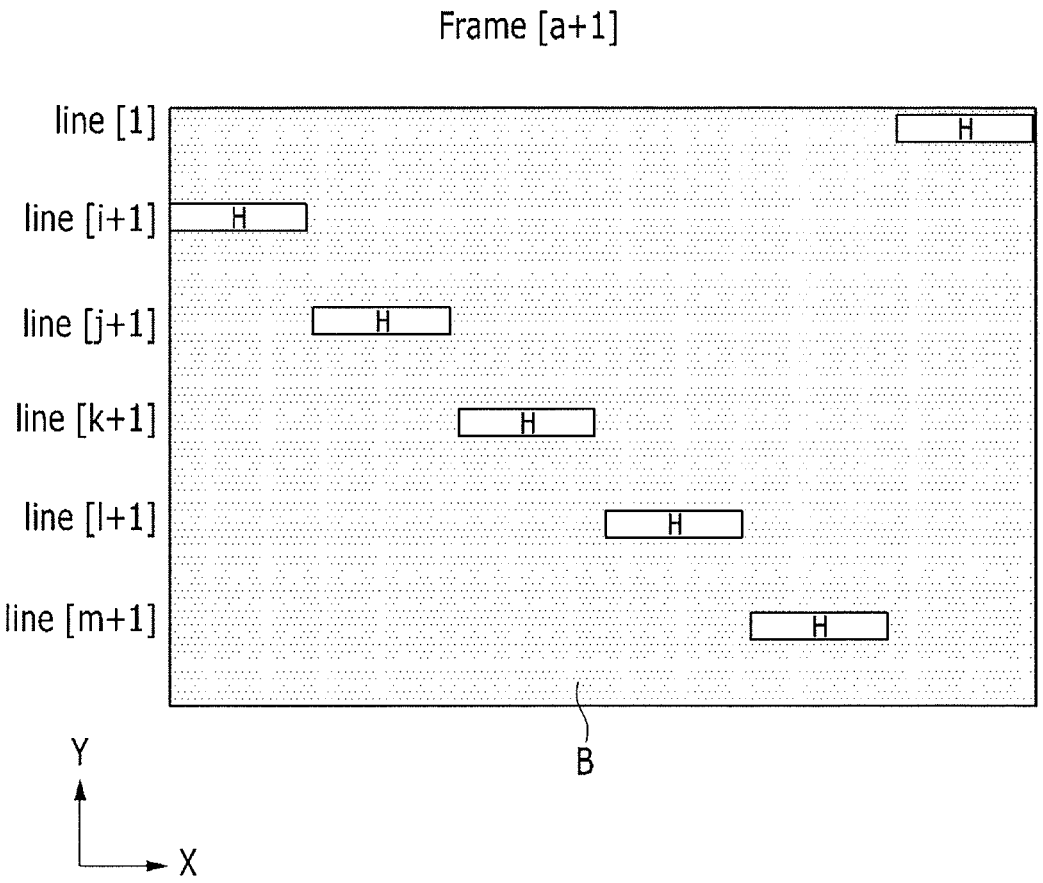

FIGS. 8 and 9 illustrate another example of a test image for measuring common voltage. This test image may display a plurality of lines line [i], line [j], line [k], line [l], line [m], and line [n] occupying regions. These regions do not overlap in the X and Y directions. Portions of these lines display a high (e.g., white) gray scale value H and remaining regions display a low (e.g., black) gray scale value B. The pixels corresponding to line [i], line [j], line [k], line [l], and line [m], and line [n] may be applied with a maximum gray scale voltage. In this case, pixels PXs corresponding to line [i], line [j], line [k], line [l], line [m], and line [n] may receive only a positive gray scale voltage. Alternatively, pixels PXs corresponding to line [i], line [j], line [k], line [l], line [m], and line [n] may receive only a negative gray voltage.

Line [i], line [j], line [k], line [l], line [m], and line [n] are displayed by the white gray H in one frame Frame [a]. Then, lines displayed by the white gray scale value H in the next frame Frame [a+1] move in a Y direction line by line. As a result, line [I+1], line [j+1], line [k+1], line [l+1], lime [m+1], line [l] are displayed by the white gray scale value H. By this method, when the common voltage Vcom is measured at a time when the line displayed by the white gray scale value H is scrolled in the Y direction, the common voltage Vcom for each X-direction line in all the pixels PXs may be measured for each of the plurality of regions.

According this method, the common voltage Vcom may be measured by applying only the positive gray scale voltage to pixel PX. Then, the common voltage Vcom may be measured by applying only the negative gray scale voltage to pixel PX.

FIGS. 6 to 9 illustrate that, in the test image, a specific pattern is displayed by white gray scale value H. In other embodiments, a specific pattern may be displayed by a low or intermediate gray scale value depending, for example, on unique characteristics of the liquid crystal. When the pixel voltage and capacitance of the liquid crystal capacitor Clc are related as in FIG. 3, and when the specific pattern is displayed by a low or intermediate gray scale value, the change in capacitance of the liquid crystal capacitor Clc is relatively large. The change in the common voltage Vcom due to the coupling may also be large or greater than the previous case. When the change in the common voltage Vcom due to the coupling is large, the level of the residual DC voltage may be more easily measured.

Referring back to FIG. 5, when the common voltage Vcom is measured by the common voltage measuring unit 500 and the measurement signal Sens is transferred to signal controller 100, the signal controller 100 normalizes a measured result (S140). The difference in capacitance of the liquid crystal capacitor Clc due to errors in the process may occur in each pixel. As a result, the common voltage Vcom changed due to coupling may be differently measured. The difference may be removed by normalizing the measured result.

Figure 10:
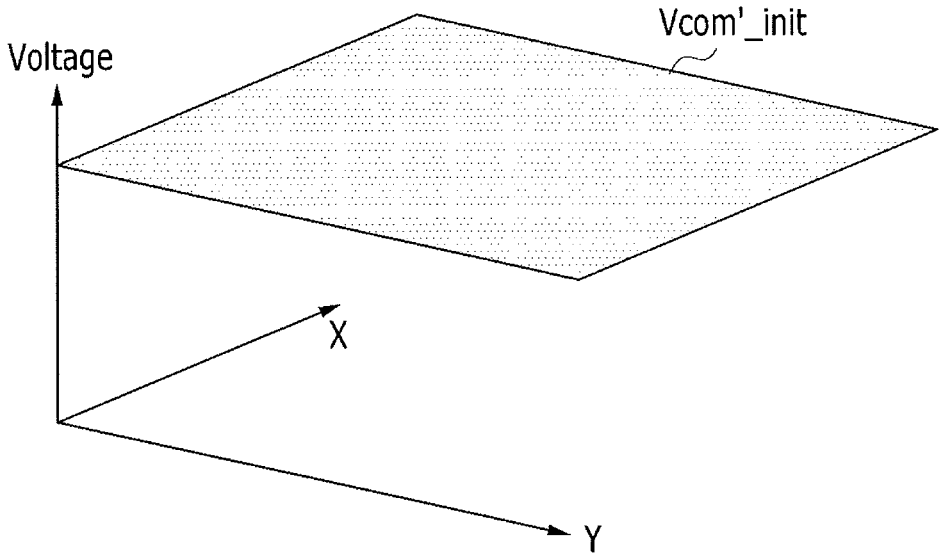
FIG. 10 illustrates an embodiment for normalizing an initial measurement result of a common voltage.

FIG. 10 illustrates an example in which an initial measurement result of the common voltage is normalized. As illustrated in FIG. 10, the initially measured common voltage Vcom is normalized to produce constant initial measurement value Vcom'_init. When it is assumed that the residual DC voltage is not generated in the pixel at the time of initial driving of the display device, the initial measurement value Vcom'_init represents the common voltage Vcom which is changed due to the coupling when no residual DC voltage is present.

Referring back to FIG. 5, signal controller 100 stores the normalized measured result as the initial measurement value Vcom'_init (S150). When the initial measurement value Vcom'_init is stored, signal controller 100 performs the process of outputting the test image and measuring the common voltage (S160). This may be performed by the same method as the process of outputting the test image and measuring the common voltage Vcom (S130), performed at the time of initial driving. The signal controller 100 may obtain a measured result Vcom'_sens of the common voltage Vcom, which has changed due to the coupling, based on the process of outputting the test image and measuring the common voltage.

The signal controller 100 compares the measured result Vcom' sens with the initial measurement value Vcom'_init (S170). When the residual DC voltage is generated in the liquid crystal capacitor Clc, the measured result Vcom'_sens and the initial measurement value Vcom'_init are different. The signal controller 100 detects the level of the residual DC voltage based on this difference.

The signal controller 100 calculates a compensation value which reduces the difference between the measured result Vcom'_sens and initial measurement value Vcom'_init (S180). The compensation value is compared with the initial measurement value Vcom'_init, and thus may be calculated as a ratio of a voltage to be compensated for each position. For example, when the measured result Vcom' sens is smaller than the initial measurement value Vcom'_init, the compensation value may be calculated as a ratio of voltages at which the gray scale voltage applied to the pixels of the corresponding region needs to be increased. When the measured result Vcom'_sens is larger than the initial measurement value Vcom'_init, the compensation value may be calculated as the ratio of voltages at which the gray scale voltage applied to the pixels of the corresponding region needs to be reduced.

Figure 11:
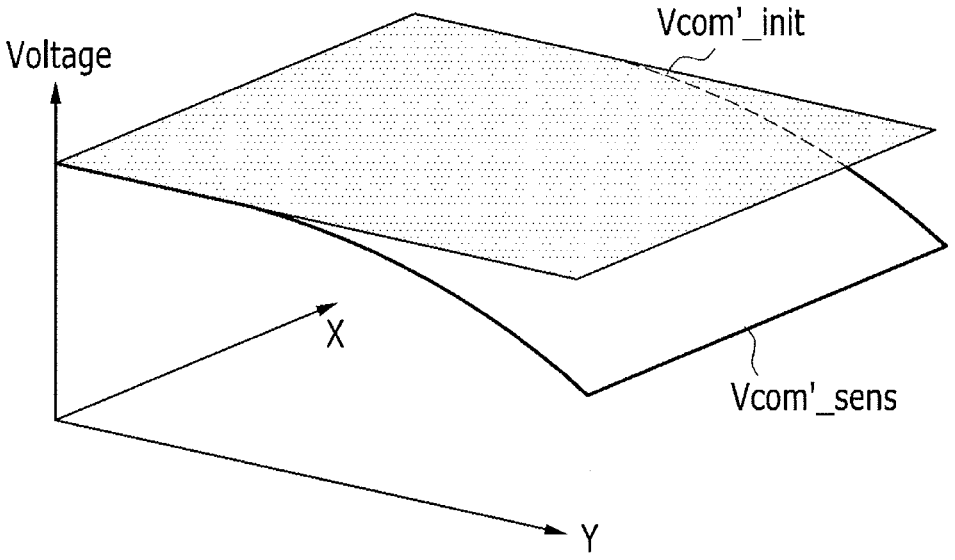
FIG. 11 illustrates an example of a comparison between an initial measurement value and a measured result of the common voltage.
Figure 12:
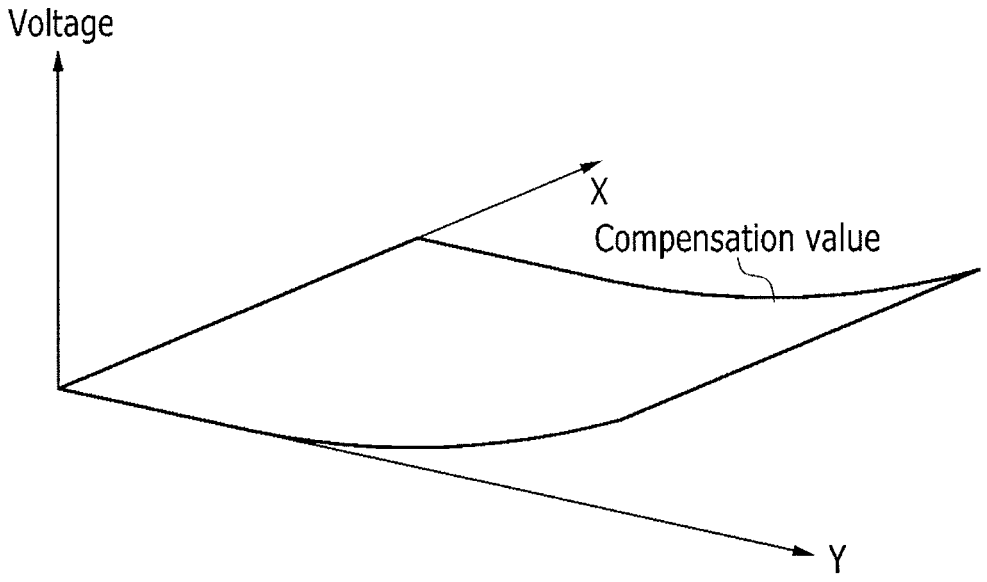
FIG. 12 illustrates an example of a compensation value calculated by comparing the initial measurement value with the measured result of the common voltage.

FIG. 11 illustrates an example in which an initial measurement value is compared with the measured result of the common voltage. FIG. 12 illustrates a compensation value calculated by comparing the initial measurement value with the measured result of the common voltage.

As illustrated in FIG. 11, the measured result Vcom'_sens of some regions may be smaller than the initial measurement value Vcom'_init. In this case, as illustrated in FIG. 12, a compensation value which may reduce the difference between the measured result Vcom'_sens and the initial measurement value Vcom'_init in the corresponding region is calculated. Referring back to FIG. 5, signal controller 100 performs a process of compensating for the residual DC voltage based on the calculated compensation value (S190).

Figure 13:
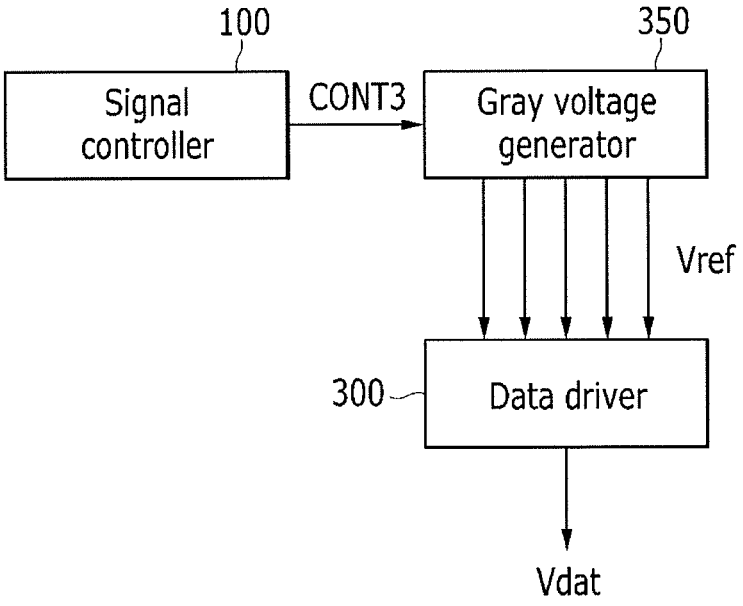
FIG. 13 illustrates an embodiment of a method for compensating for a residual DC voltage.

FIG. 13 illustrating an embodiment of a method for compensating for a residual DC voltage. Referring to FIG. 13, signal controller 100 changes a voltage value of the reference gray scale voltage Vref of the gray voltage generator 350 based on the compensation value, in order to compensate for the residual DC voltage.

The gray scale voltage generator 350 applies a reference gray scale voltage Vref to the data driver 300 in a predetermined number. The data driver 300 divides the reference gray scale voltage Vref to generate a gray scale voltage Vdat for all the gray scale values. In this case, when signal controller 100 changes the voltage value of the reference gray scale voltage Vref of the gray scale voltage generator 350 based on the gray scale voltage control signal CONT3, the gray scale voltage Vdat output from the data driver 300 is also changed.

When the reference gray scale voltage Vref of the gray scale voltage generator 350 is changed in connection with the level of the residual DC voltage, the actual pixel voltage of the liquid crystal capacitor Clc may be kept at a same level before the residual DC voltage is generated.

Figure 14:
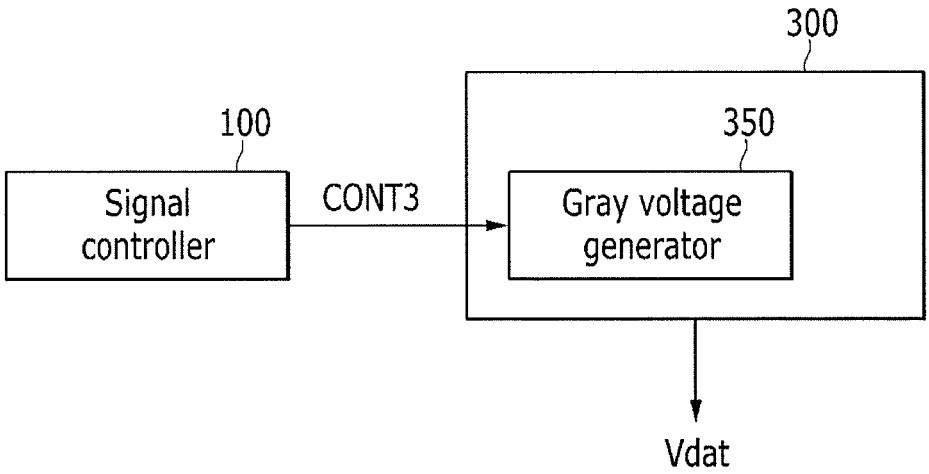
FIG. 14 illustrates another embodiment of a method for compensating for a residual DC voltage.

FIG. 14 illustrates another embodiment of a method for compensating for a residual DC voltage. Referring to FIG. 14, for this embodiment, gray voltage generator 350 is included in data driver 300. Even in this case, similar to one described in FIG. 13, signal controller 100 transfers the gray voltage control signal CONT3 to change the reference gray scale voltage Vref depending on the level of the residual DC voltage to the data driver 300. The gray voltage generator 350 in the data driver 300 changes the voltage value of the reference gray voltage Vref in order to compensate for the residual DC voltage. In FIGS. 13 and 14, the method for changing the reference gray voltage Vref is referred to as an analog voltage control method.

Figure 15:
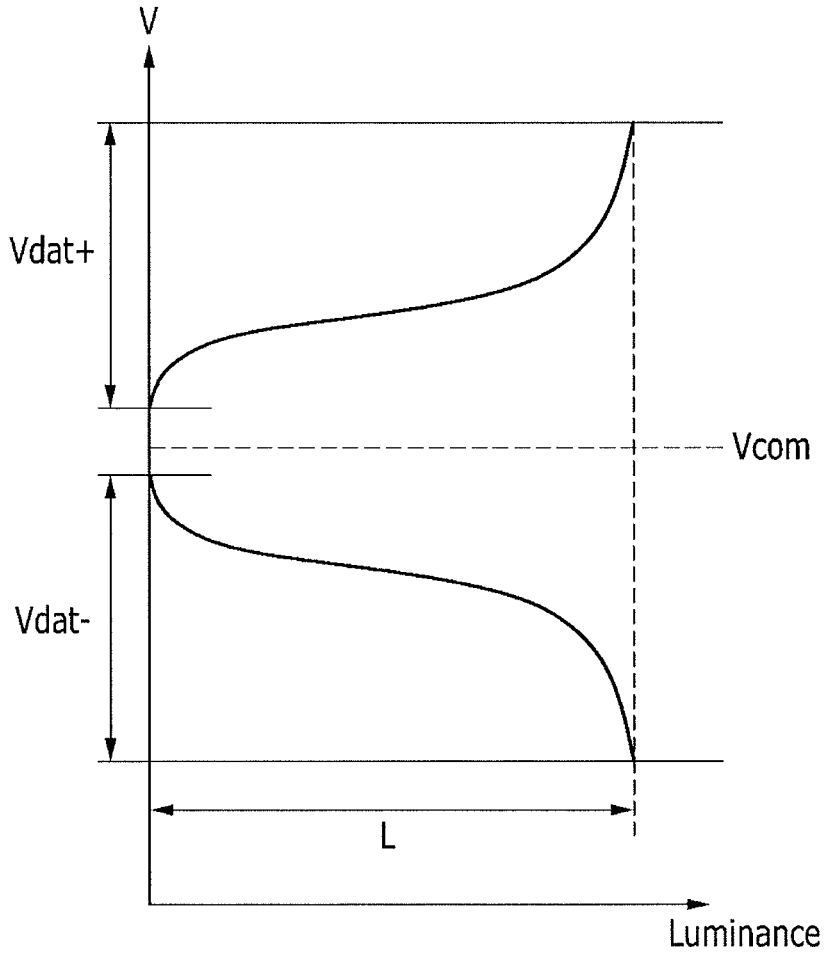
FIG. 15 illustrates an example of a relationship between luminance and pixel voltage before a residual DC voltage is generated.
Figure 16:
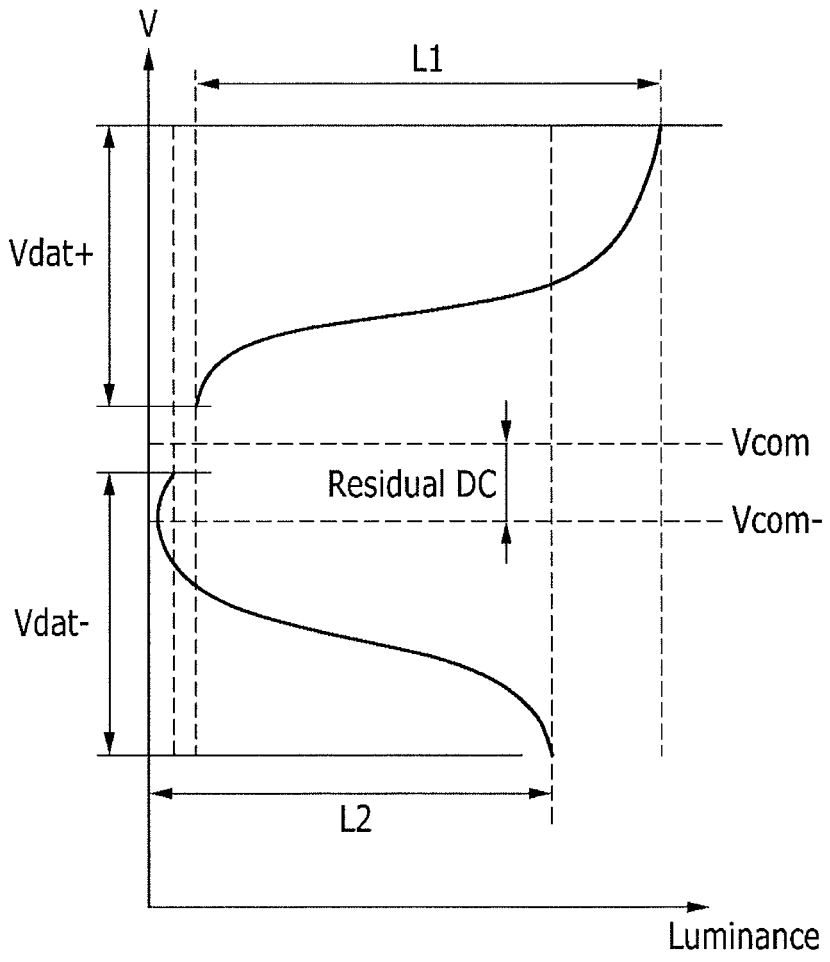
FIG. 16 illustrates an example of a relationship between luminance and pixel voltage when the residual DC voltage is generated.
Figure 17:
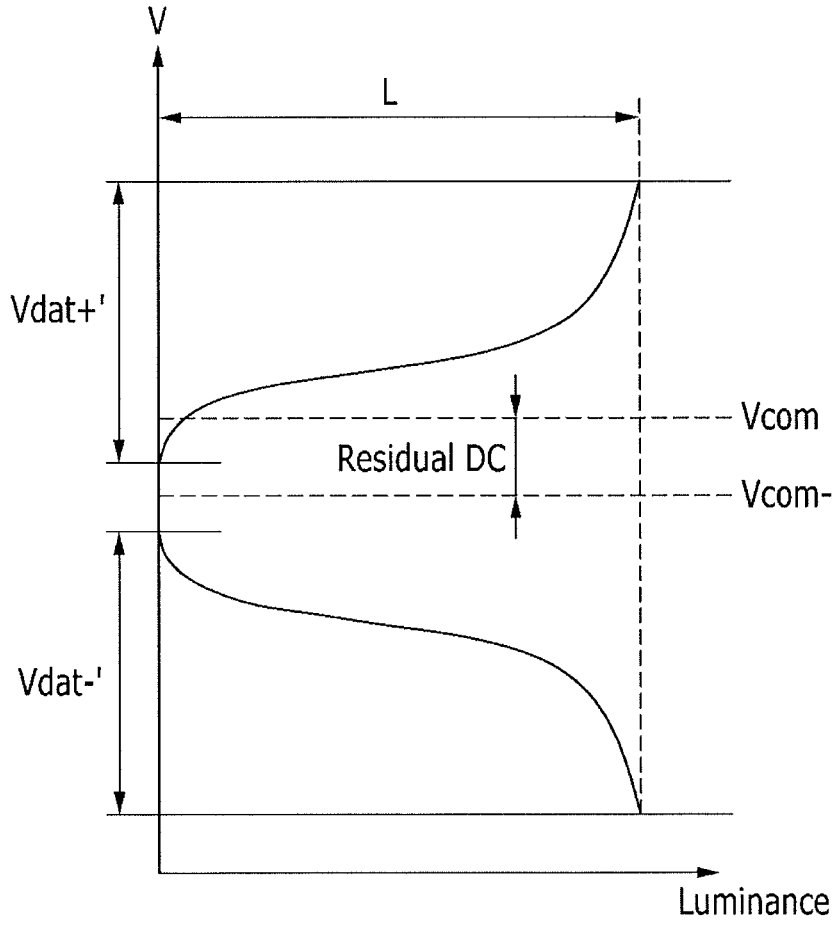
FIG. 17 illustrates an example of a relationship between luminance and pixel voltage after a residual DC voltage is compensated.

FIG. 15 is a graph illustrating an example of a relationship between luminance and pixel voltage before the residual DC voltage is generated. FIG. 16 is a graph illustrating an example of a relationship between luminance and pixel voltage when the residual DC voltage is generated. FIG. 17 is a graph illustrating a relationship between luminance and pixel voltage after the residual DC voltage is compensated.

Referring to FIG. 15, before the residual DC voltage is generated, the magnitude of the pixel voltage formed by a positive gray scale voltage Vdat+ is the same as the magnitude of the pixel voltage formed by a negative gray scale voltage Vdat−, based on common voltage Vcom. Therefore, luminance L based on positive gray scale voltage Vdat+ and luminance L based on negative gray voltage Vdat− are equally represented.

Referring to FIG. 16, when the residual DC voltage is generated, the residual DC voltage is added to the common voltage Vcom. The pixel voltage is generated in the liquid crystal capacitor Clc based on a common voltage Vcom−, to which the residual DC voltage is added. In this case, a luminance L1 based on an original positive gray scale voltage Vdat+ and a luminance L2 based on an original negative gray voltage Vdat− are different. This is a factor which causes the gray scale imbalance in the display device.

Referring to FIG. 17, when gray scale voltage Vdat is generated to compensate for the residual DC voltage as illustrated in FIG. 13 or 14, the positive gray scale voltage Vdat+ and the negative gray scale voltage Vdat− are compensated by a positive gray scale voltage Vdat+' and a negative gray scale voltage Vdat−', which may form the same pixel voltage based on the common voltage Vcom− to which the residual DC voltage is added. The compensated positive gray scale voltage Vdat+' and the compensated negative gray scale voltage Vdat−' may form the same pixel voltage based on the common voltage Vcom−, to which the residual DC voltage is added. The magnitude of the pixel voltage formed by the compensated positive gray scale voltage Vdat+' and the compensated negative gray scale voltage Vdat−' (based on the common voltage Vcom− to which the residual DC voltage is added) is the same as that of the pixel voltage formed by the positive gray scale voltage Vdat+ and the negative gray scale voltage Vdat− (based on the common voltage Vcom) before the residual DC voltage is generated.

Figure 18:
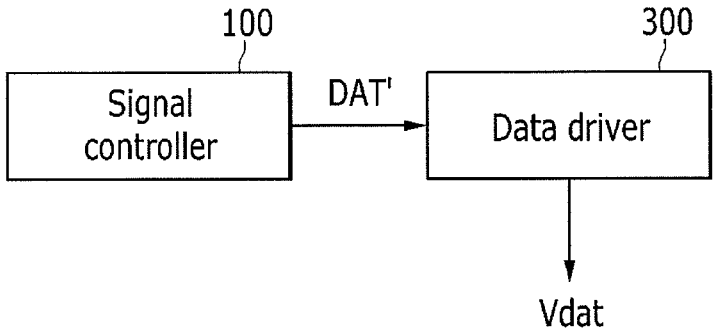
FIG. 18 illustrates another example of a method for compensating for a residual DC voltage.

FIG. 18 illustrates another embodiment of a method for compensating for a residual DC voltage. Referring to FIG. 18, signal controller 100 corrects the image data signal DAT based on the compensation value (level of the residual DC voltage) in order to generate the compensated image data signal DAT'. The signal controller 100 may transfer the compensated image data signal DAT' to data driver 300, and data driver 300 may output gray scale voltage Vdat based on compensated image data signal DAT.

For example, when image signals R, G, and B input into signal controller 100 represent the gray, signal controller 100 does not generate image data signal DAT which represents gray scale value 100 but generates image data signal DAT' compensated by gray scale value 101, gray scale value 99, or another gray scale value, based on the compensation value. The generated image data signal DAT' may be transferred to data driver 300.

The signal controller 100 stores a lookup table (LUT) which represents the compensated image data signal DAT' corresponding to the original image data signal DAT depending on the compensation value. The signal controller 100 may generate the compensated image data signal DAT' using the lookup table LUT. This method for compensating for image data signal DAT is referred to as a digital data control method.

Figure 19:
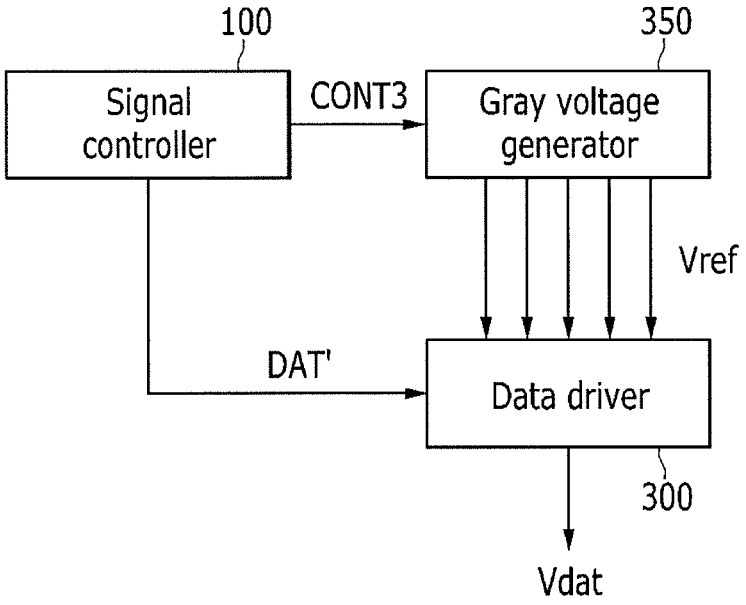
FIG. 19 illustrates another example of a method for compensating for a residual DC voltage.

FIG. 19 illustrates another embodiment of a method to compensate for residual DC voltage. The method in FIG. 19 uses both of the analog voltage control method in FIG. 13 and the digital data control method in FIG. 18.

Figure 20:
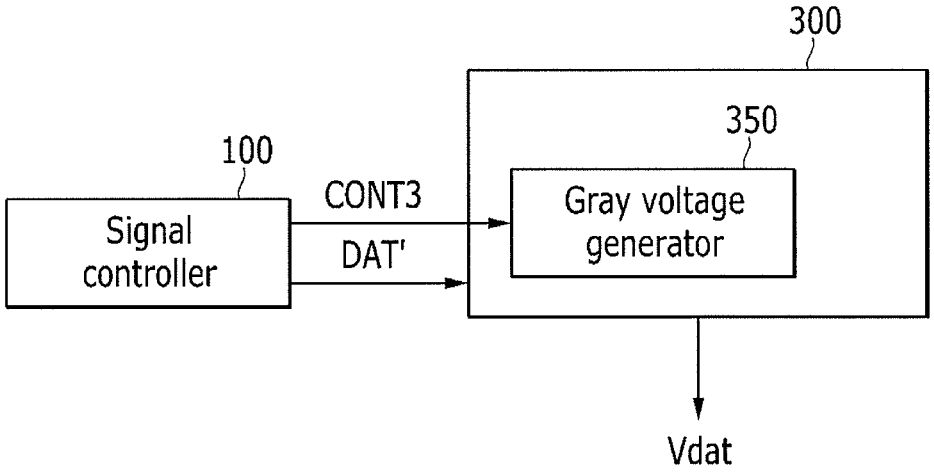
FIG. 20 illustrates another example of a method for compensating for a residual DC voltage.

FIG. 20 illustrates yet another embodiment of a method to compensate for residual DC voltage. The method in FIG. 20 uses both of the analog voltage control method in FIG. 14 and the digital data control method in FIG. 18.

Referring to FIGS. 19 and 20, when the same level of residual DC is generated over the entire screen, the effect due to residual DC voltage may be improved by the analog voltage control method. On the other hand, when the residual DC voltage is locally generated (and thus spots appear on the screen), there is a need to compensate for the image data signals DAT for each position by the digital data control method. Therefore, the residual DC voltage may be more efficiently compensated by applying both the analog voltage control method and the digital data control method.

Figure 21:
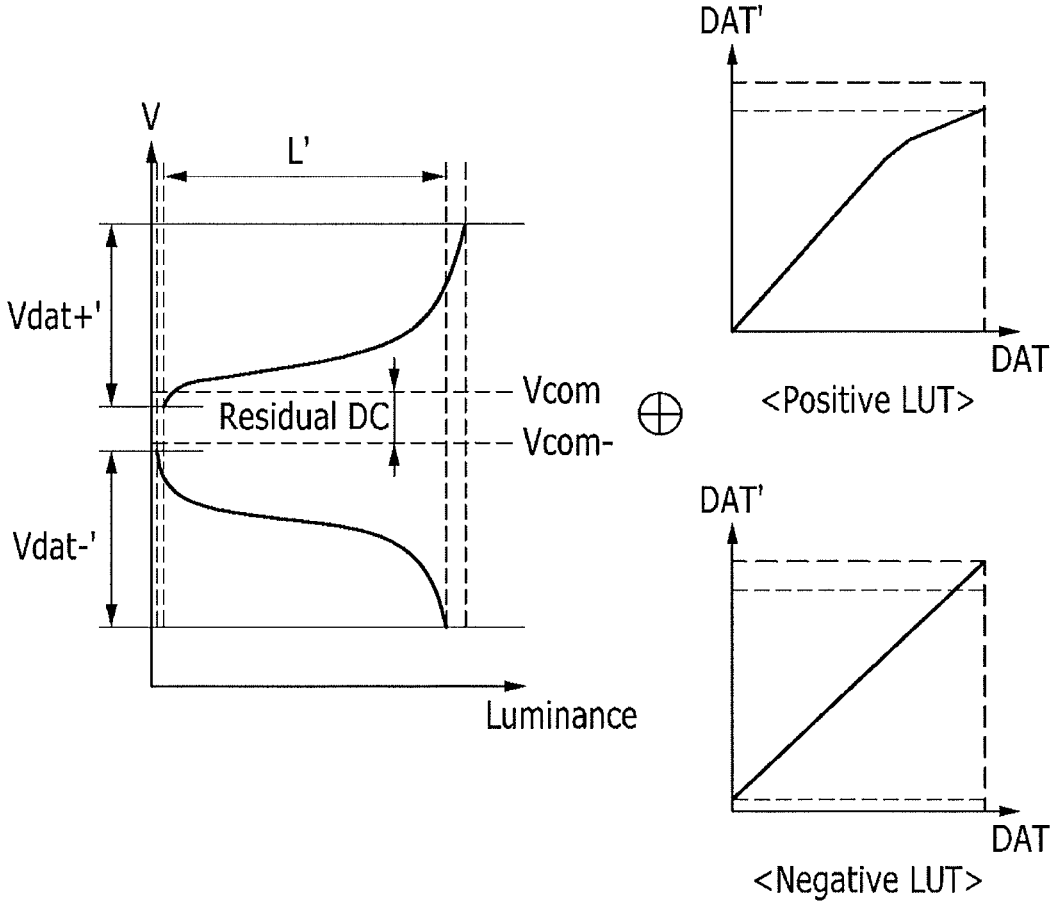
FIG. 21 is a graph illustrating a method for compensating for a residual DC voltage.

FIG. 21 is a graph for describing the method for compensating for a residual DC voltage. FIG. 21 illustrates the case in which both the analog voltage control method and digital data control method are compositely applied as illustrated in FIGS. 19 and 20. The signal controller 100 may compensate for the residual DC voltage using the analog voltage control method depending on the same level of residual DC voltage. The signal controller 100 may compensate for the residual DC voltage using the digital data control method depending on the residual DC voltage locally appearing in the screen.

When a large amount of residual DC voltage locally appears, the residual DC voltage is compensated by the analog voltage control method. Then, a slight difference between the luminance represented by the positive gray scale voltage Vdat+' and the luminance represented by the negative gray scale voltage Vdat−' may occur. In this case, the image data signal DAT may be compensated using the lookup table (LUT), so that the luminance due to the positive gray scale voltage Vdat+' is equal to the luminance due to the negative gray scale voltage Vdat−'. The lookup table (LUT) includes a positive lookup table (LUT) corresponding to the positive gray scale voltage Vdat+' and a negative lookup table (LUT) corresponding to the negative gray scale voltage Vdat−'.

As illustrated, the positive lookup table (LUT) may be set to compensate for the image data signal DAT which exceeds the luminance due to the negative gray scale voltage Vdat−'. The negative lookup table (LUT) may be set to compensate for the image data signal DAT which is less than the luminance due to the positive gray scale voltage Vdat+'. The signal controller 100 may store various types of lookup tables (LUTs).

In accordance with one or more of the aforementioned embodiments, a display device includes a display unit including a plurality of pixels, each of which includes a liquid crystal capacitor using a common electrode applied with a common voltage and a pixel electrode applied with a gray voltage as two terminals. A common voltage measuring unit measures the common voltage changed due to a coupling between the common electrode and the pixel electrode when a test image including a specific pattern is output to the display unit. A signal controller detects and compensates a level of a residual DC voltage of a liquid crystal layer between the common electrode and the pixel electrode based on a measured value of the common voltage. As a result, an imbalance of gray scale values may be reduced or prevented, which may reduce or eliminate generation of an afterimage.

The methods and processes described herein may be performed by code or instructions to be executed by a computer, processor, or controller. Because the algorithms that form the basis of the methods (or operations of the computer, processor, or controller) are described in detail, the code or instructions for implementing the operations of the method embodiments may transform the computer, processor, or controller into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, or controller which is to execute the code or instructions for performing the method embodiments described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a display unit including a plurality of pixels, each of the pixels including a liquid crystal capacitor including a terminal coupled to a common electrode to receive a common voltage and a pixel electrode to receive a gray scale voltage;

a common voltage measuring circuit to measure a change in the common voltage resulting from a coupling between the common electrode and the pixel electrode when a test image including a specific pattern is output to the display unit; and a signal controller to detect a level of a residual DC voltage of a liquid crystal layer between the common electrode and pixel electrode based on a measured value of the common voltage, wherein the common voltage measuring circuit includes:

a differential amplifier to amplify the common voltage based on a reference value; and an analog-to-digital converter (ADC) to generate a measurement signal corresponding to a level of the amplified common voltage and to transfer the generated measurement signal to the signal controller, wherein the signal controller normalizes a measured result of the common voltage at an initial driving time and stores the normalized measured result as an initial measurement value, and wherein the signal controller detects the level of the residual DC voltage based on a difference between the initial measurement value and a measured result of a subsequently measured common voltage.

2. The display device as claimed in claim 1, wherein the test image includes a plurality of lines having a white gray scale value and a remaining region having a black gray scale value.

3. The display device as claimed in claim 1, wherein the test image includes a plurality of lines having a low or intermediate gray scale value and a remaining region having a black gray scale value.

4. The display device as claimed in claim 1, further comprising:

a data driver to apply gray scale voltages to the pixels; and a gray voltage generator to apply a reference gray voltage for generating the gray voltages to the data driver, wherein the signal controller transfers a gray voltage control signal to the data driver, the gray scale voltage control single to change the reference gray voltages based on the level of the residual DC voltage.

5. The display device as claimed in claim 4, wherein the signal controller compensates for an image data signal transferred to the data driver depending on the level of the residual DC voltage.

6. The display device as claimed in claim 1, further comprising:

a data driver to apply the gray scale voltages to the pixels, wherein the signal controller transfers a gray voltage control signal to the data driver, the gray scale voltage control signal to change a reference gray scale voltage for generating the gray scale voltages depending on the level of the residual DC voltage.

7. The display device as claimed in claim 6, wherein the signal controller compensates for an image data signal transferred to the data driver depending on the level of the residual DC voltage.

8. The display device as claimed in claim 1, further comprising:

a data driver to apply gray scale voltages to the pixels, wherein the signal controller compensates for an image data signal transferred to the data driver depending on the level of the residual DC voltage.

9. A method for driving a display device, the method comprising:

outputting a test image to a display unit;

measuring a common voltage which has changed due to coupling between a common electrode and a pixel electrode of a pixel in the display unit; and detecting a level of a residual DC voltage of a liquid crystal layer between the common electrode and pixel electrode based on a measured value of the common voltage, wherein measuring of the common voltage includes:

amplifying the common voltage based on a reference value; and generating a measurement signal corresponding to a level of the amplified common voltage, wherein detecting of the level of the residual DC voltage includes:

normalizing a measured result of the common voltage at an initial driving time and stores the normalized measured result as an initial measurement value; and detecting the level of the residual DC voltage based on a difference between the initial measurement value and a measured result of a subsequently measured common voltage.

10. The method as claimed in claim 9, wherein outputting of the test image to a display unit includes displaying a plurality of lines on the display unit having a white gray scale value and displaying a remaining region having a black gray scale value.

11. The method as claimed in claim 9, wherein outputting of the test image to a display unit includes displaying a plurality of lines on the display unit having a low or intermediate gray scale value and displaying a remaining region thereon having a black gray scale value.

12. The method as claimed in claim 9, further comprising:

determining whether the initial measurement value is stored when a power supply is turned on.

13. The method as claimed in claim 12, further comprising:

outputting a test image in the display unit when the initial measurement value is not stored, measuring the common voltage which has changed due to the coupling between the common electrode and pixel electrode when the test image is output, normalizing a measured result of the common voltage, and storing the normalized measured result as an initial measurement value.

14. The method as claimed in claim 9, further comprising:

changing a reference gray scale voltage for generating a gray scale voltage to be applied to the pixel electrode depending on the level of the residual DC voltage.

15. The method as claimed in claim 9, further comprising:

compensating for an image data signal transferred to a data driver by applying a gray voltage to the pixel depending on the level of the residual DC voltage.

16. The method as claimed in claim 9, further comprising:

changing a reference gray scale voltage for generating a gray voltage applied to the pixel electrode depending on the level of the residual DC voltage; and compensating for an image data signal transferred to a data driver applying a gray scale voltage to the pixel depending on the level of the residual DC voltage.

* * * * *